US007802504B1

(12) United States Patent
Wilkes

(10) Patent No.: US 7,802,504 B1
(45) Date of Patent: Sep. 28, 2010

(54) HIGH SPEED TRANSVERSE CUTTER FOR WEBS

(75) Inventor: Kenneth R. Wilkes, Asheville, NC (US)

(73) Assignee: Smart Bottle Inc., Asheville, NC (US)

( * ) Notice: Subject to any disclaimer, the term of this patent is extended or adjusted under 35 U.S.C. 154(b) by 1969 days.

(21) Appl. No.: 10/064,227

(22) Filed: Jun. 21, 2002

(51) Int. Cl.
*B26D 1/08* (2006.01)
*B26D 5/20* (2006.01)
*B26D 5/42* (2006.01)
*B26D 7/02* (2006.01)

(52) U.S. Cl. ..... 83/74; 83/257; 83/282; 83/375; 83/380

(58) Field of Classification Search ..... 83/76, 83/354, 362, 327, 328, 74, 209–211, 236, 83/257, 262, 282, 359, 363, 369–371, 373, 83/375, 380, 382, 385, 399, 400, 949
See application file for complete search history.

(56) References Cited

U.S. PATENT DOCUMENTS 2,995,968 A * 8/1961 Tomberg ..... 83/74
3,025,740 A * 3/1962 Sorkin ..... 83/282
3,178,974 A * 4/1965 Roess ..... 83/76
3,267,781 A * 8/1966 Sterns et al. ..... 83/37
3,442,168 A * 5/1969 Gatto ..... 83/354
3,686,987 A * 8/1972 Colinet et al. ..... 83/37
3,982,454 A * 9/1976 Schneider et al. ..... 83/74
3,998,119 A * 12/1976 Schroter ..... 83/328
4,020,406 A * 4/1977 Tokuno et al. ..... 318/600
4,193,329 A * 3/1980 Strunc ..... 83/250
4,453,436 A * 6/1984 Tokuno ..... 83/76
4,497,229 A * 2/1985 Carrington et al. ..... 83/76
4,635,511 A * 1/1987 Shirasu ..... 83/74
4,669,344 A * 6/1987 Herrig ..... 83/27
4,739,490 A * 4/1988 Hayashi et al. ..... 700/167
5,286,317 A * 2/1994 Treat et al. ..... 156/64
5,765,460 A * 6/1998 Wathieu ..... 83/37
5,777,879 A * 7/1998 Sommerfeldt ..... 700/125
5,800,325 A 9/1998 Wilkes ..... 493/22
6,024,683 A * 2/2000 Wilkes ..... 493/196
2004/0069105 A1 * 4/2004 Martin et al. ..... 83/30

* cited by examiner

*Primary Examiner*—Clark F. Dexter

(57) ABSTRACT

A web transport system operates cyclically to advance a web and provide a synchronization signal at a known point in a cutting cycle. A drive system oscillates a cutting knife from a resting position to an active position and back in response to an actuating signal. A sensor in the path of the cutting knife provides a position signal when the cutting knife is at a predetermined position that is substantially different than the resting position. A controller receives the synchronization signal, provides the actuating signal at a time relative to the synchronization signal, receives the position signal, and adjusts subsequent actuating signals in response to the position signal so that the cutting knife arrives at the predetermined position substantially at a predetermined point in the cutting cycle.

7 Claims, 7 Drawing Sheets

HIGH SPEED TRANSVERSE CUTTER FOR WEBS

BACKGROUND OF INVENTION

The invention relates to improvements in apparatus for transverse cutting of webs or strips of paper, plastic sheet stock, metallic foils, or the like. In particular, the invention relates to a means for operating a cutting knife at high speeds. The invention is applicable to the transverse cutting of webs of a variety of materials and in a variety of settings.

Web production methods are used for producing items in which the raw materials are supplied as webs—long continuous strips of thin material. Various processes may be performed on the web of material to produce a product. The web may move continuously through a process or the web may be advanced to a process and then stopped while the process is performed. At some point, the web is cut apart to release the individual product from the web. If multiple products are produced across the width of the web, they may be separated by slitting knives that cut the web along the direction of travel, typically as a continuous operation as the web advances through the slitting process. The products that are produced sequentially along the length of the web may be separated by a transverse cutting operation, which is typically the last step of web production. The transverse cutting may cut a single web or a number of webs produced by slitting in an earlier process. The transverse cutting speed may be a limiting factor in the overall rate of production that can be achieved by a web production method.

A pouch making machine as disclosed in U.S. Pat. No. 5,800,325 is an example of a web production method that employs a transverse web cutter. FIG. 1 is a schematic side view of an exemplary pouch making machine. The pouches fabricated by the machine of FIG. 1 start out as two webs of pouch material 11 and 12. These two webs are joined by being seamed together to form a single web 110. The seaming iron 18 used to create the perimeter seams on the pouches may simultaneously form the seams for a number of pouches along the length of the web 110. The seaming iron may be any number of pouches wide, as is economical under the circumstances. The two webs of sheet stock 11 and 12 are fed into the pouch making machine from two rolls 13 and 14. The webs 11 and 12 are drawn into the machine by rollers 15/16. One or both of these rollers are driven by a motor 17. The motion is intermittent in that the webs are drawn rapidly into the machine for a period of time, and then the motion stops for some other period of time to allow the perimeter seams of the pouches to be made by the hot seaming iron 18 being pressed against a platen 19. The seaming iron 18 is pressed against the platen 19 by one or more hydraulic or pneumatic actuators 22 under the control of a first control system 21. A sensor 20 may provide a signal to the first control system 21 to indicate the position or speed of the web. A typical duration for the seaming process and subsequent cooling is about two seconds.

As the rollers 15/16 are drawing the webs 11 and 12 under the seaming iron, the web section on which pouch seams have previously been formed is passed into an accumulator portion of the machine. The accumulator is the portion of the machine between rollers 15/16 and roller 23. As the web 110 is fed into the accumulator, gravity causes a dancer roller 24 to move downward and accommodate the web being fed in. A high limit sensor, such as a photo-detector 32 and light source 34, detects a shortage of web material in the accumulator section. The signal from the high limit sensor may be sent to a controller for one of the adjacent processes to increase the amount of web material in the accumulator section. For example, the second controller 29 may respond to the high limit sensor 32, 34 by slowing a transverse web cutter 10 to increase the amount of web material in the accumulator section. Similarly, a low limit sensor, such as a photo-detector 33 and light source 35, detects an excess of web material in the accumulator section. The signal from the low limit sensor may be sent to a controller for one of the adjacent processes to reduce the amount of web material in the accumulator section. For example, the second controller 29 may respond to the low limit photo-sensor 33, 35 by speeding up the transverse web cutter 10 to reduce the amount of web material in the accumulator section.

While the web is being fed into the accumulator by rollers 15/16, rollers 25/26 withdraw material from the accumulator and feed it to a transverse cutting knife 27, where the individual pouches are cut off the web. Rollers 25/26 are intermittently driven by a motor 28 under the control of a second control system 29, advancing the web one pouch at a time to the cutting knife, and stopping to permit the knife to sever the pouch. A sensor 31 may provide a signal to the second control system 29 to indicate the position or speed of the web. A drive system 30 operates the cutting knife 27 to oscillate the cutting knife from a resting position to an active position and back to the resting position. It is desirable that the cutter be operable over a range of speeds up to a speed that allows pouches to be cut from the web at the same rate as they are produced by the seaming operation.

Generally, it is desirable to operate a cutter at high speeds. However, a higher speed cutter is more expensive to produce. It would be desirable to produce less expensive cutters that operate at higher speeds.

SUMMARY OF INVENTION

A web transport system operates cyclically to advance a web and provides a synchronization signal at a known point in a cutting cycle. A drive system oscillates a cutting knife from a resting position to an active position and back in response to an actuating signal. A sensor in the path of the cutting knife provides a position signal when the cutting knife is at a predetermined position that is substantially different than the resting position. A controller receives the synchronization signal, provides the actuating signal at a time relative to the synchronization signal, receives the position signal, and adjusts subsequent actuating signals in response to the position signal so that the cutting knife arrives at the predetermined position substantially at a predetermined point in the cutting cycle.

DETAILED DESCRIPTION

Figure 1:
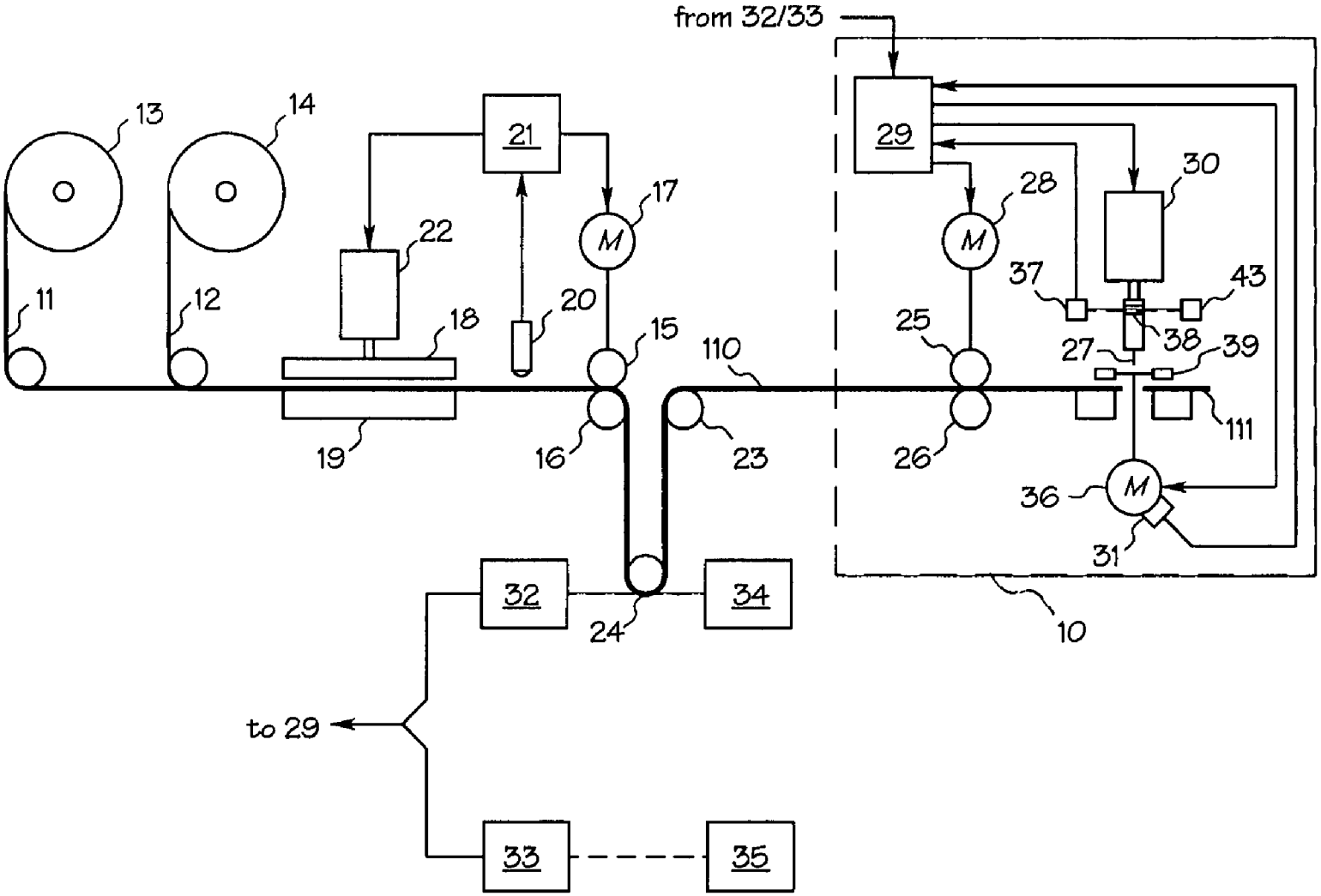
FIG. 1 is a schematic side view of an exemplary web production method that makes pouches, and further includes a block diagram representation of exemplary control circuitry for coordinating the various functions.

FIG. 1 is a schematic side view of an exemplary web production method that includes an embodiment of the present invention. An overview of the operation of this production method is presented in the Background of the Invention section. The production method includes a transverse web cutter 10 to separate products 111 that have been produced sequentially along the length of the web 110. Each cutting cycle may include advancing the web by the length of one product, clamping the web adjacent to the line that will be cut, and cutting the web to sever the product from the web. The cutting cycle is performed with an appropriate synchronization between the operations.

Figure 2:
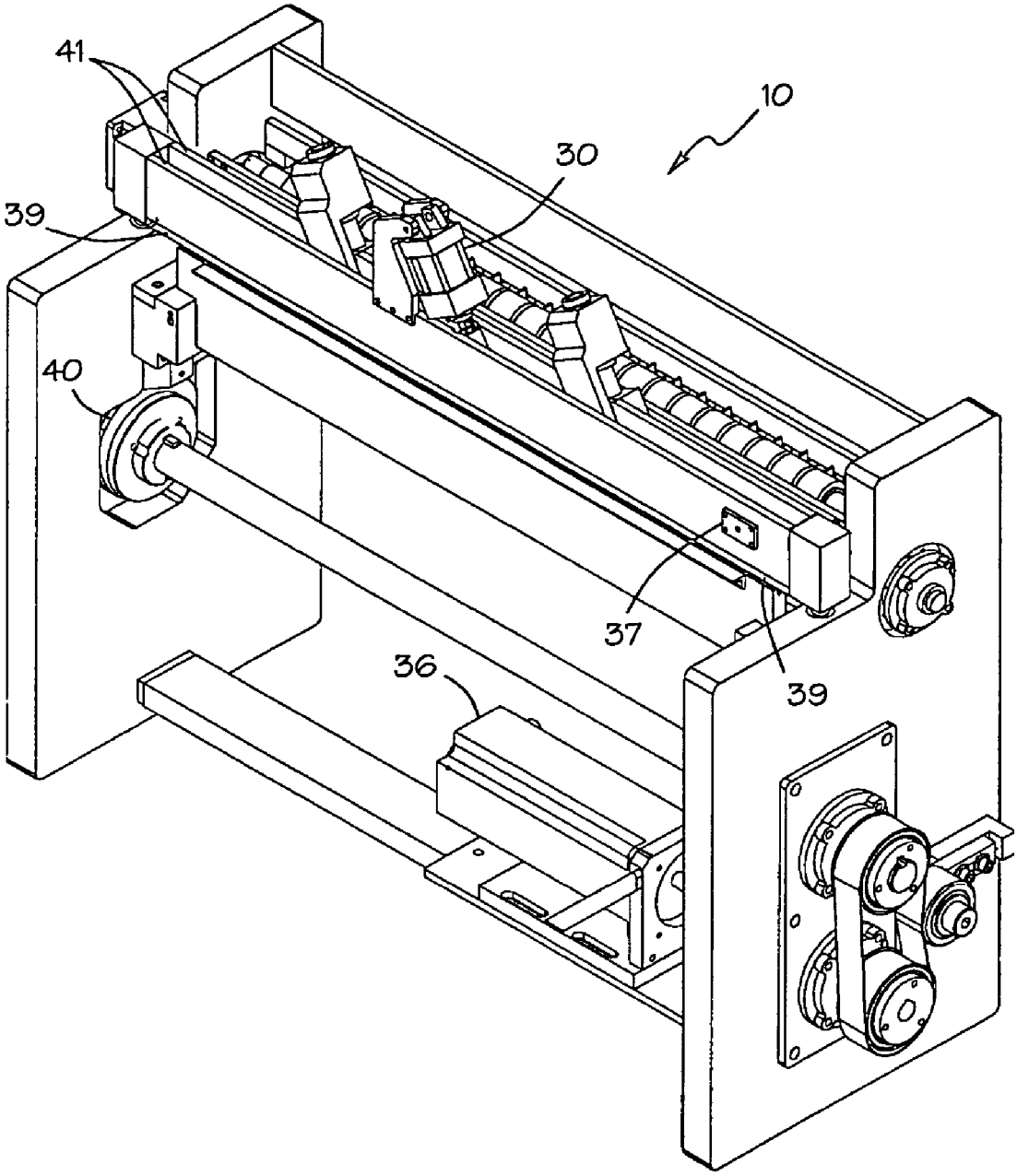
FIG. 2 is a pictorial view of an exemplary web cutter.
Figure 3:
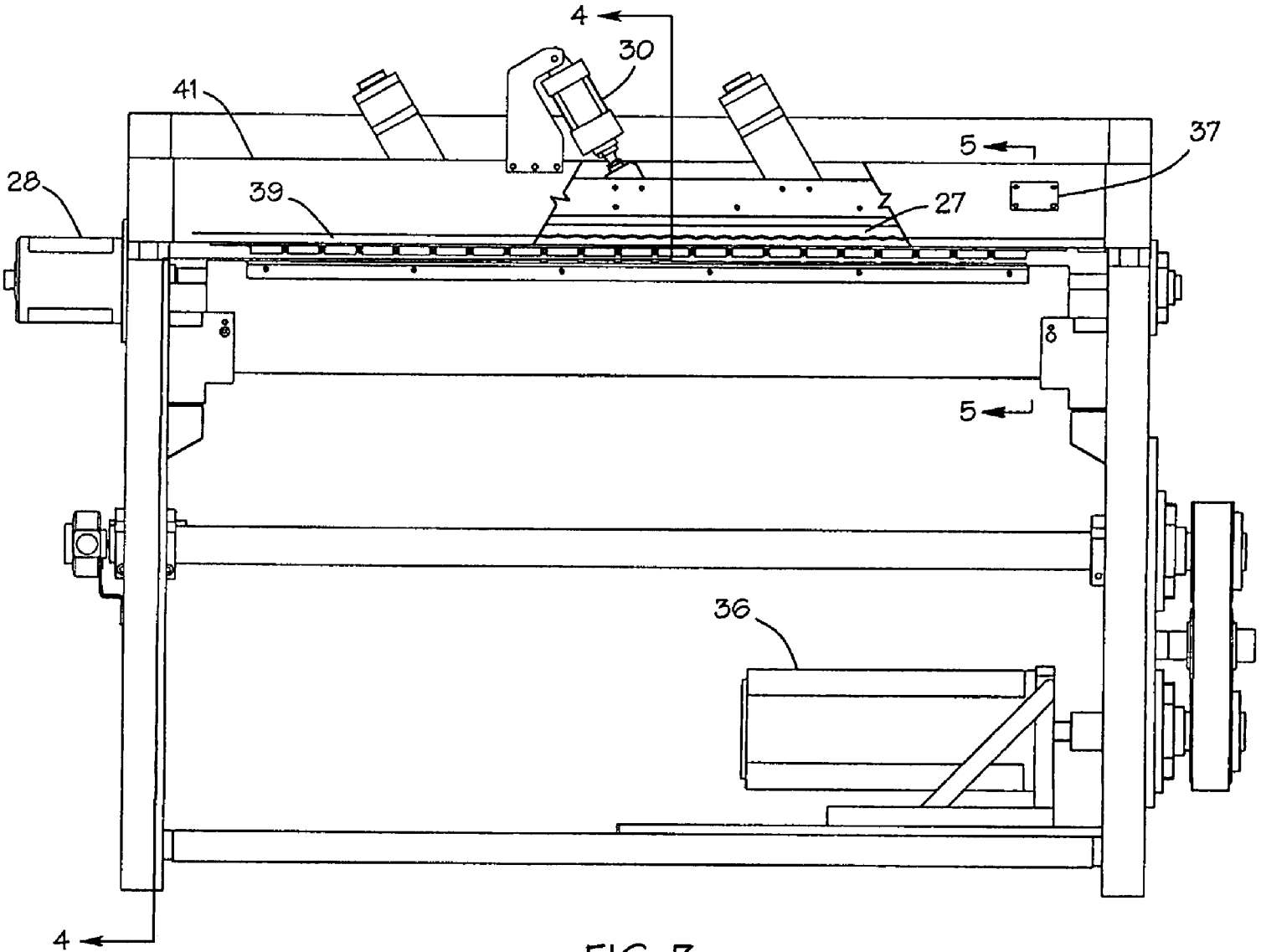
FIG. 3 is a front elevation of the exemplary web cutter.
Figure 4:
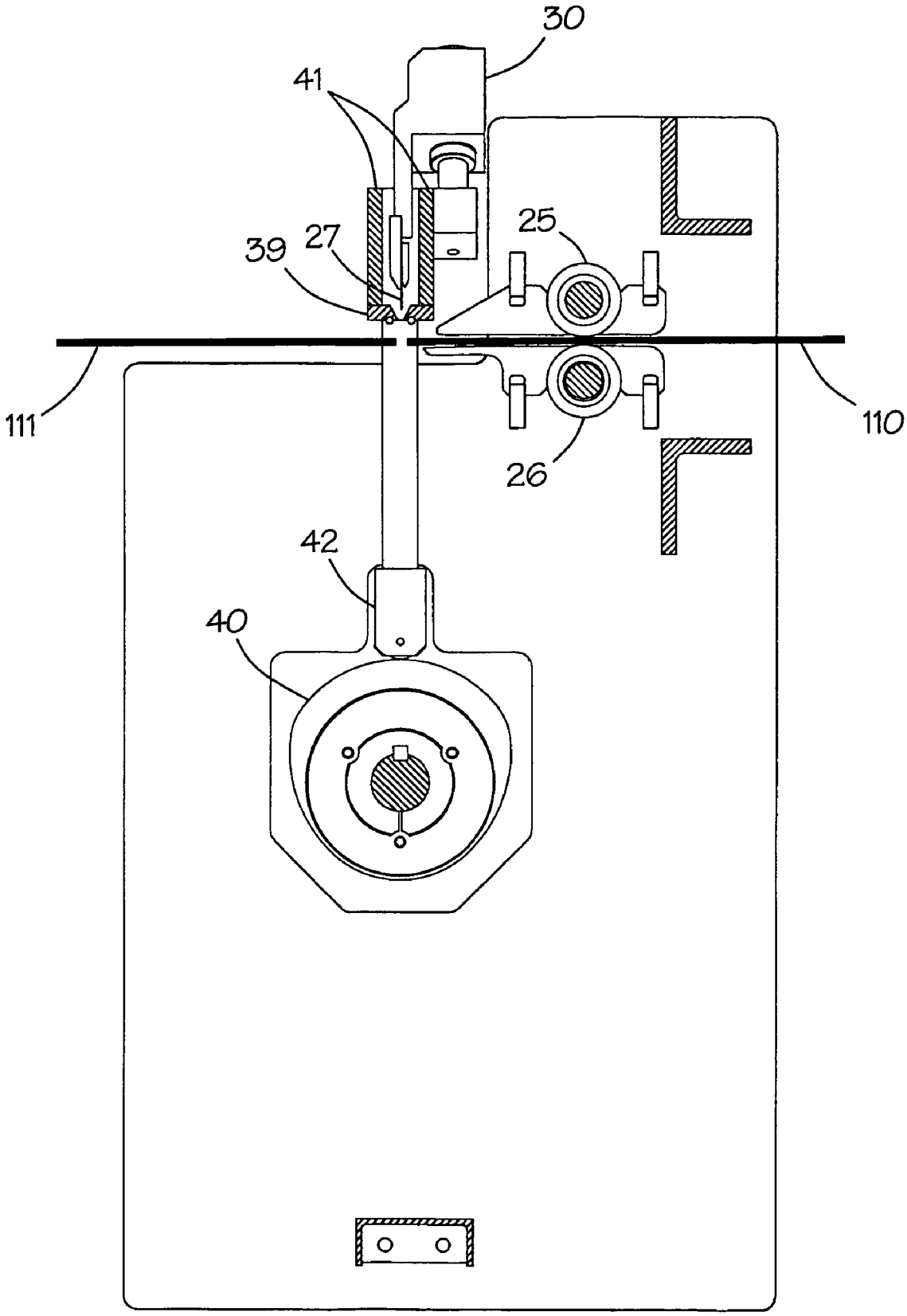
FIG. 4 is a cross-section of the exemplary web cutter taken along line 4-4 in FIG. 3.
Figures 5A, 5B, 5C, 5D:
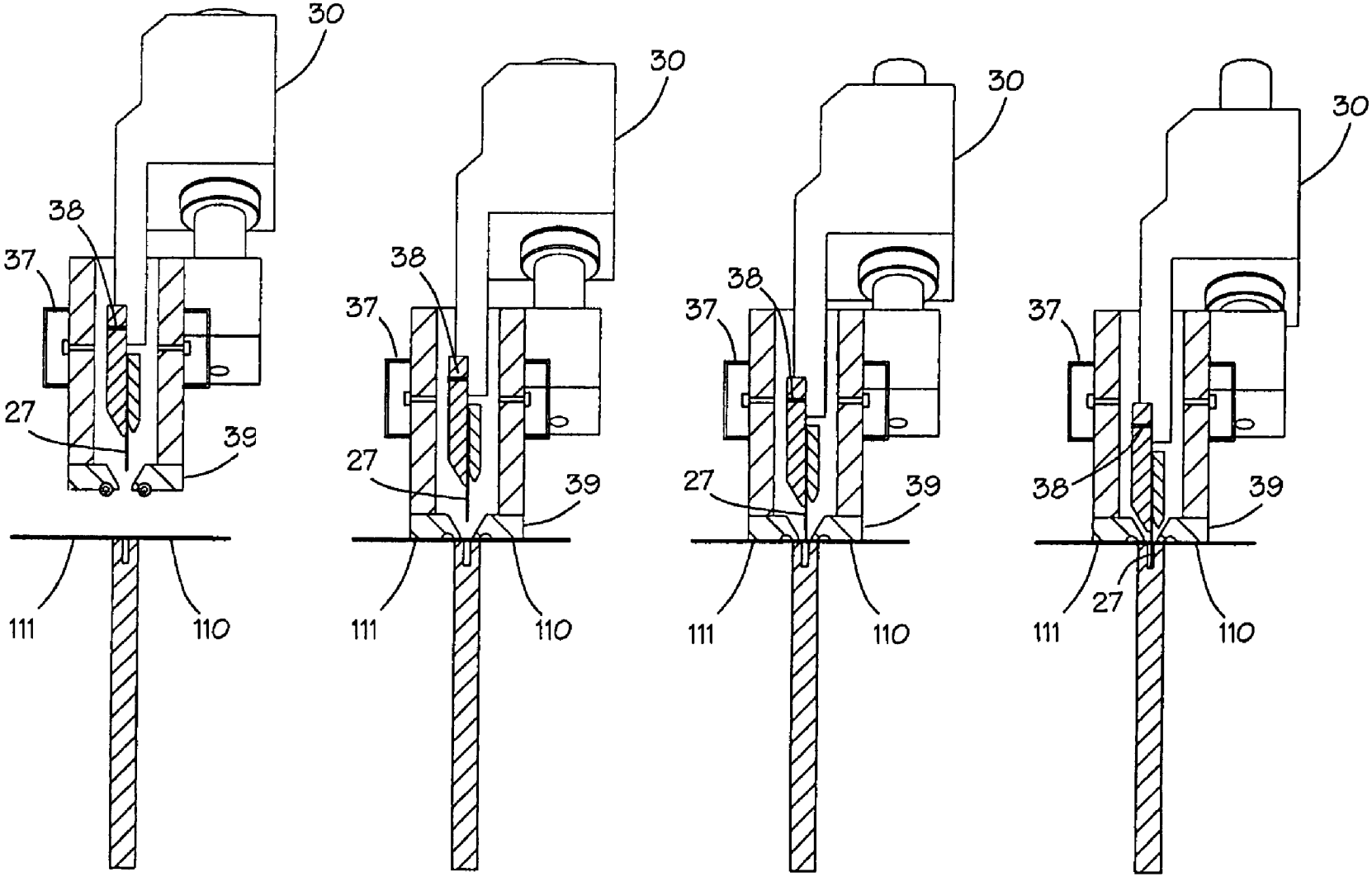
FIGS. 5A-D are cross-sections of the clamp and cutting knife portion of the exemplary web cutter at various operative positions taken along line 4-4 in FIG. 3.

FIG. 2 is a pictorial view of an exemplary transverse web cutter 10. The direction of web travel is from the upper right of the figure to the lower left. It will be appreciated that the cutting station shown receives a number of webs produced by slitting in an earlier process and the transverse cutting knife 27 will cut all of the parallel webs created by slitting. The operation of the invention is the same for these parallel webs as it is for a single web. In this web cutter the web clamps 39 are supported by support bars 41 that extend across the width of the web cutter. The drive system 30 for the transverse cutting knife (not visible in FIG. 2) is also supported by the support bars 41 in this web cutter. FIG. 3 is a front elevation of the web cutter shown in FIG. 2 with a portion of the support bar 41 cut away so the transverse cutting knife 27 can be seen. FIG. 4 is a section view along line 4-4 of FIG. 3 showing an exemplary mechanism for operating the clamps 39.

The web cutter includes a web transport system to cyclically advance the web. In the exemplary transverse web cutter 10, the web 110 is intermittently and cyclically advanced by an upper roll 25 and a lower roll 26 which engage the web. A first motor 28 rotates the rolls to advance the web 110 one product length at a time. The first motor may be intermittently energized or the rolls 25, 26 may be intermittently driven by the motor 28 to provide the intermittent advance.

In the web transport system of the exemplary transverse web cutter 10, the web 110 is clamped by two clamps 39 that engage the web 110 just ahead and just behind the line where the web is to be severed to release a finished product 111. In this web cutter 10, a second motor 36 operates the clamps 39. The second motor rotates a cam 40 which lifts the support bars 41 by means of a push rod and cam follower 42. The support bars may be spring loaded to urge the support bars downward. When the support bars 41 are permitted to lower by rotation of the cam 40, the clamps 39 engage the web 110. The web transport system provides a synchronization signal at a known point in each cutting cycle. The synchronization signal may be derived from any source that provides a reasonably consistent point of reference for the time when the web will be stopped and ready for cutting. The synchronization signal may be provided at some point in the cutting cycle before the time when the web should be cut. It will be appreciated that regardless of where in the cutting cycle the synchronization signal occurs, the synchronization signal will always precede a cutting operation by no more than the length of one cutting cycle.

A drive system 30 is coupled to the cutting knife 27. The drive system 30 operates to oscillate the transverse cutting knife 27 by advancing the knife from a resting position to an active position and then retracting the knife to the resting position. The drive system 30 responds to an actuating signal to begin each oscillation of the cutting knife 27 from a resting position to an active position and back to the resting position. In the exemplary transverse web cutter 10, the transverse cutting knife 27 is driven by drive system 30 in the form of a pneumatic or hydraulic actuator. The actuator may be double acting to both advance and retract the transverse cutting knife 27 or a spring may retract the knife. In the exemplary cutter 10, the actuator is supported by the support bars 41. Thus the cutting knife 27 is partially advanced and retracted by the clamping operation.

The operations of the web cutter 10 are synchronized by a control system 29. Sensors 32, 34 and 33, 35 may be provided to detect the presence of the dancer roll 24, wherein the sensors may include photo-detectors 32, 33 that sense a light source 34, 35. In other embodiments other types of sensors may be used to sense the position of the dancer roll. The control system 29 receives a signal, such as the signal from the accumulator system sensors 32, 34, and 33, 35 to control the speed of the web cutter 10. It will be appreciated that the control system 29 may be integrated with other control systems 21 in a single unit. It will be appreciated that the long term average speed (length of web processed in a given time) of all the web processes must be the same. The accumulator only accommodates instantaneous differences in speed between adjacent processes. When the dancer roll 24 rises above the upper sensor 32, 34 the cutter may be signaled to reduce its speed. Conversely, when the dancer roll 24 falls below the lower sensor 33, 35 the cutter may be signaled to increase its speed. In other systems, the speed of the web cutter 10 may be set to a particular value and the speed of preceding operations may be adjusted to match the speed of the web cutter.

The control system may control the first motor 28 to intermittently advance the web 110 at the speed set by the received speed setting signal. The control system may then control the second motor 36 to lower the clamps when the web advance is complete. The control system may then provide a signal to actuate the cutter drive system 30 and cause the drive system to oscillate the cutting knife from the resting position to the active position and back to the resting position. Finally, the control system may control the second motor 36 to raise the clamps. The cutting cycle then repeats beginning with another advance of the web. While the cutting cycle has been described as a series of discrete operations, it will be appreciated that it is desirable to keep some or all of the motors in continuous operation because of the inertia of the machine parts. In particular, it may be desirable to operate the second motor 36 continuously and control the clamping operation by the arrangement of the cam 40. The cam 40 may be provided in two or more adjustable parts so that the length and timing of the clamp lift are adjustable.

It may be advantageous to use the rotation of the cam 40 or second the motor 36 that drives the cam to provide the synchronization signal for synchronizing the cutting of the web 110 with the motion of the web produced by the web transport system. The advance of the web, such as by operation of the first motor 28 and the rollers 25/26, may be synchronized to the rotation of the cam 40. Advancing may be synchronized to the clamping by energizing the first motor 28 at the point of the cam 40 rotation when the clamps are lifted and advancing the web at a speed sufficient to complete the advance at or before the point of the cam 40 rotation when the clamps are lowered. In another embodiment, clamping may be synchronized to the advancing mechanism. In another embodiment, advancing and clamping may be synchronized by a mechanical coupling of the advance mechanism and the clamping mechanism which may be driven by a single motor.

The drive system 30 that oscillates the cutting knife 27 may be a pneumatic or hydraulic actuator or other mechanism that receives a signal to begin the advance of the cutting knife to sever the product 111 from the web 110. The drive system may then proceed through the oscillatory cutting cycle without further control. In particular, the drive system may not provide positive positioning for the oscillatory movement. Factors such as changes in friction of the knife support mechanism or changes in knife sharpness may affect the timing of the cutting knife 27 motion. Therefore, there may be a comparatively large amount of variability in the time of the severing of the web relative to the time when the drive system 30 is actuated. This variability limits the speed of the cutter 10 since the web must remain clamped for the entire range of times when the cutting knife 27 may sever the web.

The synchronization of web cutting to web clamping may be improved by providing a sensor 37, 43 that provides a position signal when the cutting knife 27 is at a predetermined position that is substantially different than the resting position. The sensor 37, 43 may be a photo-detector 37 that detects light from a light source 43 passing through an opening 38 in the cutting knife. Other forms of sensors that will provide a reasonably accurate and repeatable position signal based on the position of the cutting knife may be used. The sensor may detect when the cutting knife is just touching the web, when the cutting knife is fully advanced, or some other position that is substantially different than the resting position of the cutting knife.

The control system 29 uses the position signal provided by the sensor 37 sensor 37, 43 to adjust subsequent actuating signals so that the cutting knife 27 arrives at the predetermined position at a predetermined time relative to the synchronization signal. The control system 29 may use the position signal to determine the length of time between providing the actuating signal and the cutting knife 27 reaching the predetermined position. The control system 29 may then adjust the timing of subsequent actuating signals to reduce the variability in the time when the cutting knife 27 reaches the predetermined position relative to the synchronizing signal and hence the variability of the timing of the cut within the cutting cycle. The synchronization signal may occur earlier than the earliest possible time for providing the actuating signal.

The control system may maintain a delay value which is the length of time after the synchronization signal when the actuating signal is provided. The control system may adjust the timing by increasing or decreasing the delay value to advance or retard the actuating signal relative to the synchronization signal. If the control system 29 adjusts the actuating signal to cause the cutting knife 27 to reach the predetermined position based on time, the control system may determine the time when the cutting knife should reach the predetermined position based on the speed of the transverse web cutter 10. The delay value may be increased if the cutoff knife arrives at the predetermined position too soon after the synchronization signal or if the speed of the web cutter is reduced. The delay value may be decreased if the cutoff knife arrives at the predetermined position too long after the synchronization signal of if the speed of the web cutter is increased.

In another embodiment, the web advance system may provide positional synchronization signals that can be used to determine the position of the web advance system within the cutting cycle. Such synchronization signals may be provided by a sensor 31, such as a shaft encoder, on a part that rotates continuously throughout the cutting cycle. In one embodiment, the rotation of the motor 36 that drives the clamp activating cam 40 may provide such synchronization signals. Positional synchronization signals may be provided in another embodiment by a stepper motor where the signals that actuate the motor can be used to create positional synchronization signals. A sensor that detects a reference point may be used to correct accumulated errors in synchronization signals derived from stepper motor actuation signals.

If the web advance system provides positional synchronization signals, the control system 29 may advance or retard the actuating signal within the cutting cycle by changing the selection of the particular positional synchronization signal used to trigger the actuating signal. The control system may use the positional synchronization signals to determine if the cutting knife 27 arrived at the predetermined position, based on the position signal provided by the sensor 37, 43 at a predetermined point in the cutting cycle. If the cutting knife 27 arrives at the predetermined position too soon within the cutting cycle, the controller 29 selects a later positional synchronization signal to trigger the actuating signal. If the cutting knife 27 arrives at the predetermined position too late within the cutting cycle, the controller 29 selects an earlier positional synchronization signal to trigger the actuating signal. If the rate of change of cutter speed is moderate, the timing adjustments based on positional synchronization signals may be sufficient to adjust the timing of the actuating signal as required by changes in the cutter speed.

As the cutter speed is increased, the time per cutting cycle is decreased. At a cutting speed of 5 cycles per second (cps), each cutting cycle is 200 milliseconds (mSec). A typical breakdown for the 200 mSec cutting cycle is 150 mSec for advancing the web and 50 mSec clamp time. Increasing the precision of the timing of the cutting within the time allocated to clamping allows the web cutter to operate at speeds of at least 5 cps.

Figure 6:
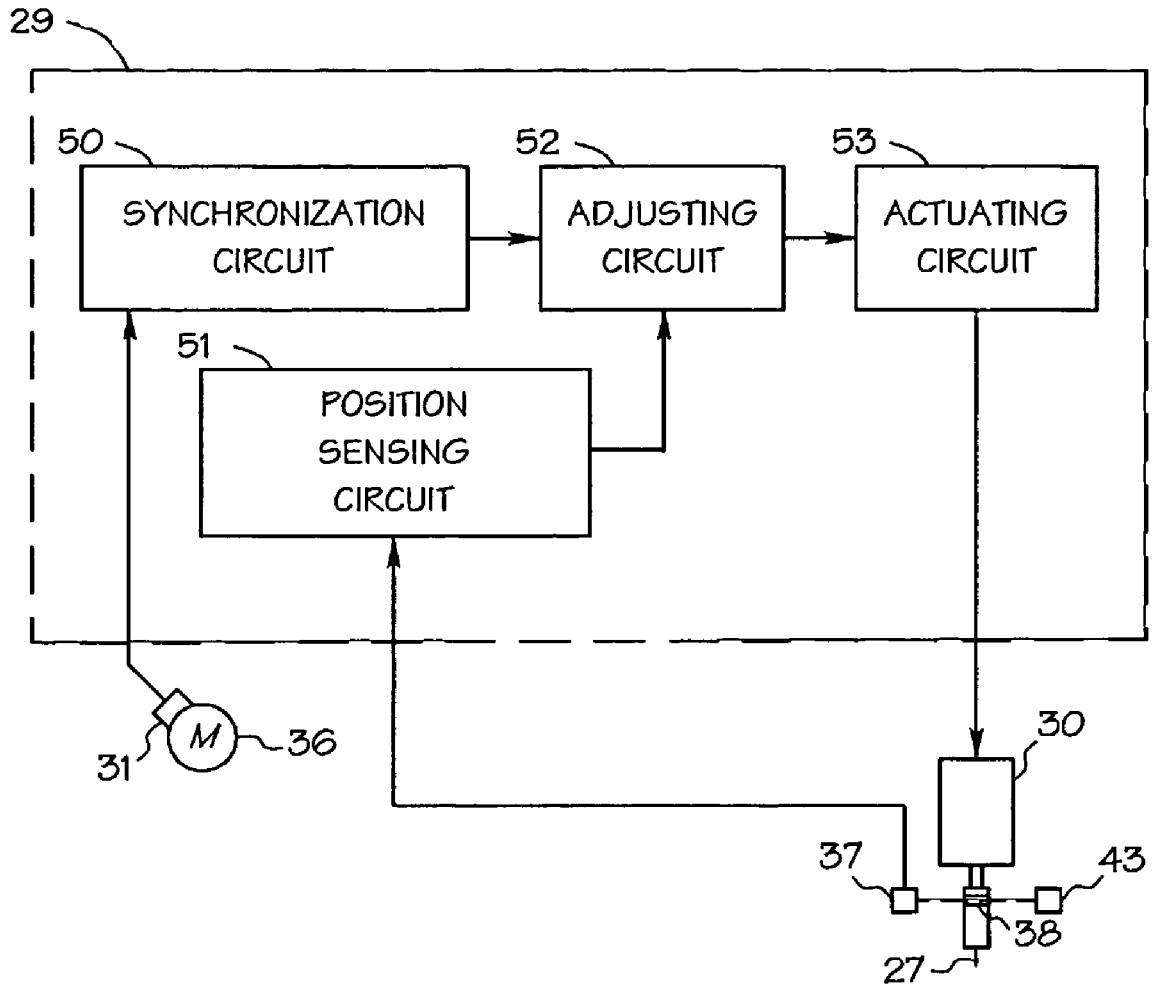
FIG. 6 is an exemplary block circuit diagram of a controller for operating the web cutter.

FIG. 6 shows a block diagram of an embodiment of the controller 29. A synchronization circuit 50 receives a synchronization signal from the web transport system. In the embodiment shown, the sensor 31 may provide the synchronization signal at a known point in the rotation of a motor 36 that drives a clamping cam 40. The synchronization signal provides a known point in each cutting cycle. An actuating circuit 53 provides an actuating signal to the drive system 30 to cause the drive system to oscillate the cutting knife 27 from a resting position to an active position and back to the resting position. A position sensing circuit 51 receives a position signal from a knife position sensor 37, 43 when the cutting knife 27 is at a predetermined position that is substantially different than the resting position. The predetermined position may be substantially at a position where the cutting knife 27 is in contact with the web 110 prior to cutting the web.

An adjusting circuit 52 is coupled to the synchronization circuit 50, the position sensing circuit 51, and the actuating circuit 53. The adjusting circuit 52 receives the synchronization signal and causes the actuating circuit 53 to provide the actuating signal to the drive system 30. The adjusting circuit 52 may wait for a delay time after receiving the synchronization signal before signaling the actuating circuit. The adjusting circuit receives the position signal from the position sensor 37, 43 and determines if the cutting knife 27 has arrived at the predetermined position early or late in the cutting cycle. If the position signal is early, the adjusting circuit increases the delay time. If the position signal is late, the adjusting circuit decreases the delay time. Thus the adjusting circuit causes the actuating circuit to provide subsequent actuating signals so that the cutting knife arrives at the predetermined position at a predetermined time relative to the synchronization signal.

Figure 7:
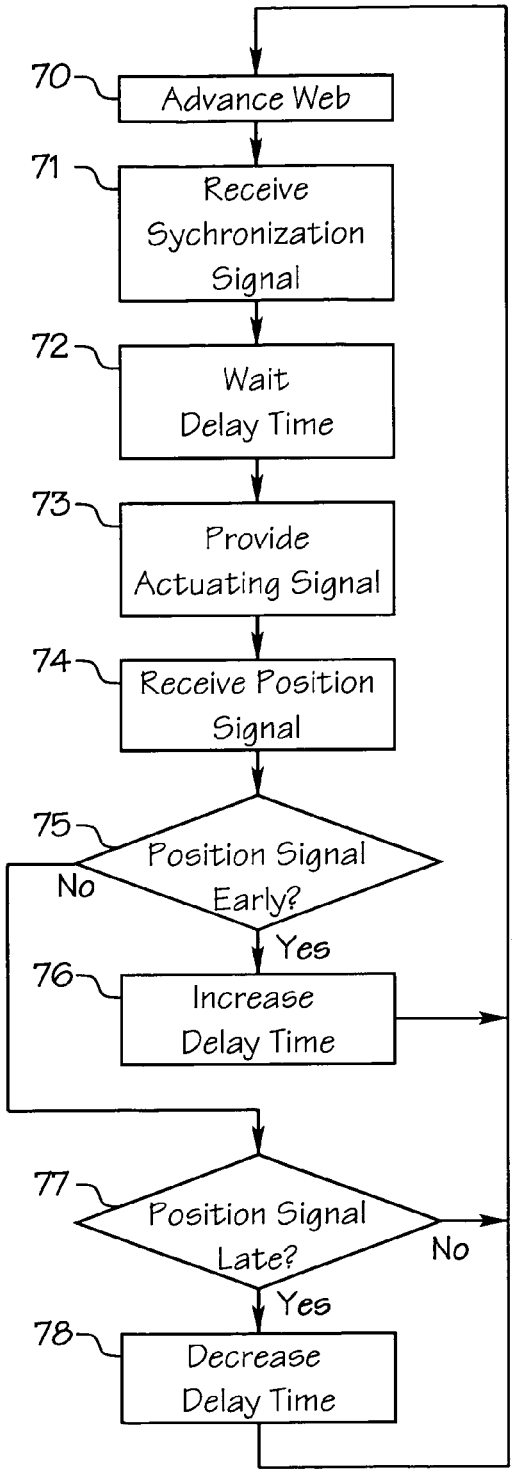
FIG. 7 is an exemplary flow chart for the method of operating a web cutter.

FIG. 7 is a flow chart for the method of operation of the transverse web cutter. The web cutter 10 advances 70 a web of material 110 past a cutting knife 27. A synchronization signal is received 71 at a known point in each advancing of the web. After waiting a delay time 72, an actuating signal is provided 73 to cause a drive system 30 to oscillate the cutting knife 27 from a resting position to an active position and back to the resting position. A position signal is received 74 when the cutting knife 27 is at a predetermined position that is substantially different than the resting position. Subsequent actuating signals are adjusted so that the cutting knife arrives at the predetermined position at a predetermined time relative to the synchronization signal in response to the received position signal. If the position signal is early 75, the delay time is increased 76. If the position signal is late 77, the delay time is decreased 78.

In another embodiment, the synchronization signals provided by the sensor 31, which may be a shaft encoder, may allow the phase within the cutting cycle to be determined. The adjusting circuit 52 may compare the synchronization signal to a target value and cause the actuating circuit 53 to provide the actuating signal substantially at the point within the cutting cycle that corresponds to the target value. The adjusting circuit 52 may compare the synchronization signal to a goal value when the position signal is received to determine if the cutting knife has arrived early or late relative to the desired point in the cutting cycle and the target value accordingly.

Figure 8:
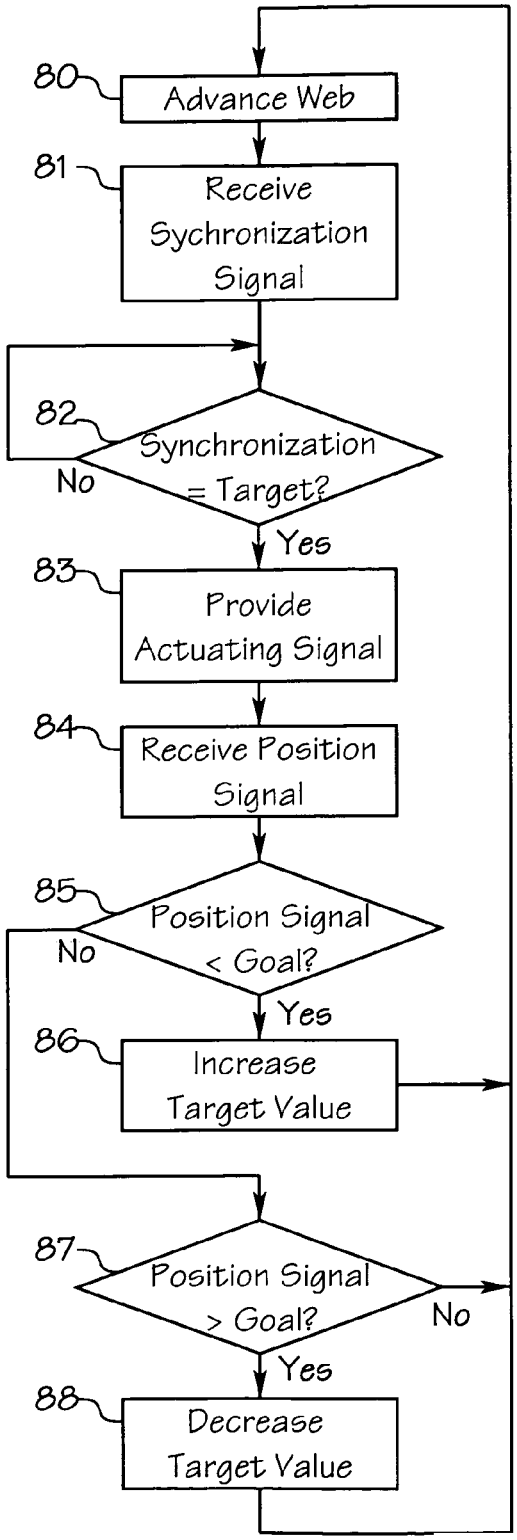
FIG. 8 is an exemplary flow chart for another method of operating a web cutter.

FIG. 8 is a flow chart for another method of operation of the transverse web cutter when position synchronization signals are provided. The web cutter 10 advances 80 a web of material 110 past a cutting knife 27. A synchronization signal is received 81 indicating the progress of the cutting cycle. After waiting until the synchronization signal equals a target value 82, an actuating signal is provided 83 to cause a drive system 30 to oscillate the cutting knife 27 from a resting position to an active position and back to the resting position. A position signal is received 84 when the cutting knife 27 is at a predetermined position that is substantially different than the resting position. Subsequent actuating signals are adjusted so that the cutting knife arrives at the predetermined position at a predetermined time relative to the synchronization signal in response to the received position signal. If the positional signal is less than a goal value 85, the target value is increased 86 to cause the actuating signal to be provided later in the cutting cycle. If the position signal is greater than a goal value 87, the target value is decreased 88 causing the actuating signal to be provided earlier in the cutting cycle.

What has been described is a machine and method for transverse cutting of products from a web at speeds which have heretofore been considered impractical for inexpensive cutting knives. Persons skilled in the art will no doubt be able to make various modifications and adaptations of the invention but yet be within the inventive teachings disclosed both explicitly and implicitly herein. The limits of the invention sought to be protected are defined by the following claims.

The invention claimed is:

1. A cutter for a web which comprises:

a web transport system that operates to intermittently and cyclically advance a web, the web transport system providing a synchronization signal at a known point of its operation in a cutting cycle that corresponds to a point when the web is stopped and ready for cutting;

a drive system coupled to a cutting knife, the drive system oscillating the cutting knife from a resting position to an active position and back to the resting position in response to an actuating signal;

a sensor in the path of the cutting knife, the sensor providing a position signal when the cutting knife is at a predetermined position that is substantially different than the resting position; and a controller coupled to the web transport system, the drive system, and the sensor, the controller further comprising a synchronization circuit to receive the synchronization signal from the web transport system;

an actuating circuit to provide the actuating signal to the drive system;

a position sensing circuit to receive the position signal from the sensor; and an adjusting circuit coupled to the synchronization circuit, the position sensing circuit, and the actuating circuit, the adjusting circuit capable of automatically adjusting the timing between the synchronization signal and the actuating signal based on the timing between the previous synchronization signal and the corresponding previous position signal to cause the actuating circuit to provide subsequent actuating signals so that the cutting knife arrives at the predetermined position at a predetermined time relative to the corresponding synchronization signal.

2. The cutter as recited in claim 1, wherein the synchronization signal allows the phase within the cutting cycle to be determined.

3. The cutter as recited in claim 1, wherein the drive system includes a pneumatic actuator.

4. The cutter as recited in claim 1, wherein the drive system includes a hydraulic actuator.

5. The cutter as recited in claim 1, wherein the predetermined position is substantially at a position where the cutting knife is in contact with the web prior to cutting the web.

6. The cutter as recited in claim 1, wherein the web transport system includes a clamp adjacent to the cutting knife, the clamp to hold the web while the web is being cut.

7. The cutter as recited in claim 6, wherein the drive system is supported by the clamp such that the cutting knife is moved toward the web when the clamp is moved towards the web to hold the web.

* * * * *